United States Patent [19]

Wyss

[11] 3,943,675

[45] Mar. 16, 1976

[54] GRATING

[76] Inventor: Otto Wyss, 33 Kreuzbuhlstrasse, 6045 Meggen, Switzerland

[22] Filed: Mar. 11, 1975

[21] Appl. No.: 557,436

[30] Foreign Application Priority Data

Mar. 12, 1974 Switzerland ..... 3457/74

[52] U.S. Cl. ..... 52/177; 52/667

[51] Int. Cl.[2] ..... E04C 2/42

[58] Field of Search ..... 52/177, 667, 669

[56] References Cited

UNITED STATES PATENTS 2,031,779 2/1936 Ladd ..... 52/669 X 3,469,359 9/1969 Nagin ..... 52/177

*Primary Examiner*—J. Karl Bell

*Attorney, Agent, or Firm*—Sughrue, Rothwell, Mion & Zinn

[57] ABSTRACT

A grating assembly comprises a plurality of inverted T-shaped cross pieces 2 each having a plurality of slots 3 in the upper flange. The slots have convexly curved central walls 4. A plurality of transverse profile bars 1 have curved lower flange portions 1*c* that engage in the slot curvatures when assembled. The latter is implemented by bending the pieces 2 to open the slot mouths and facilitate the bar insertions.

3 Claims, 7 Drawing Figures

GRATING

BACKGROUND OF THE INVENTION

1. Field of the Invention

The present invention relates to a grating composed of interlocking longitudinal profile bars and slotted cross pieces. It is intended for coverings, sheathings, etc.

The object of the invention is to produce a grating composed of profile parts which are stored individually and can be assembled in the simplest possible manner.

2. Description of the Prior Art

Gratings of this type are already known. However, costly welding or pressing operations are generally required to assemble these gratings. Gratings are also known which can be assembled by screwing or bolting them together. These can be assembled on the assembly site, but a relatively long period of time is required to put them together. The latter also consist of a large number of individual parts which makes storage difficult.

SUMMARY OF THE INVENTION

The object of the present invention is to produce a grating which can be walked on, which consists of a minimum number of individual parts and which can be produced economically. It should also meet the required standards in terms of providing satisfactory ventilation and should possess a suitable form.

The grating according to the invention is characterized in that the slots punched in the cross pieces comprise a hollow defined by curved walls at a specific distance from the upper edge 2*a*. It is further characterized in that the longitudinal profile bars are without slots and their parts which engage in the slots of the cross pieces comprise a wall part which is bent to one side, the convex side of this part resting flexibly against the one wall of the slot hollow. The invention is further characterized in that the longitudinal profile bars are held in the slots in a form-locking manner and are flexibly clamped by virtue of the elastic prestressing of the cross pieces.

By virtue of this configuration, it is possible to produce extruded profile bars of specific lengths which can then be cut to the desired lengths as necessary. As machine made slots only have to be provided in the cross pieces, the cost of producing the gratings is reduced to a minimum.

The present invention also relates to a process for producing the gratings according to the invention. This process is characterized in that the slotted cross pieces are elastically bent by clamping them on a convex molded body in such a way that the upper sides of the slots are widened. The longitudinal profile bars are then inserted into the widened slots. The cross pieces are subsequently released and the slots regain their original dimensions, thus flexibly gripping the longitudinal profile bars.

Other objects, features and advantages of the present invention will be made apparent from the following detailed description of two preferred embodiments thereof provided with reference to the accompanying drawings.

BRIEF DESCRIPTION OF THE DRAWINGS

FIG. 6 is a cross-sectional view along the line VI—VI in FIG. 7 through the second embodiment in completely assembled form.

DESCRIPTION OF THE PREFERRED EMBODIMENTS

Figure 1:
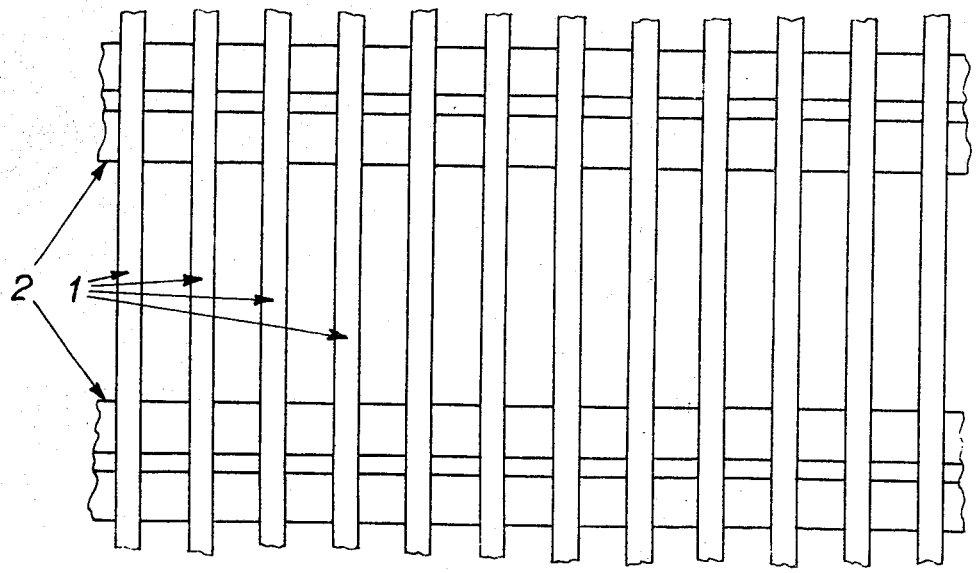
FIG. 1 is a plan view of a first embodiment of a grating.
Figure 2:
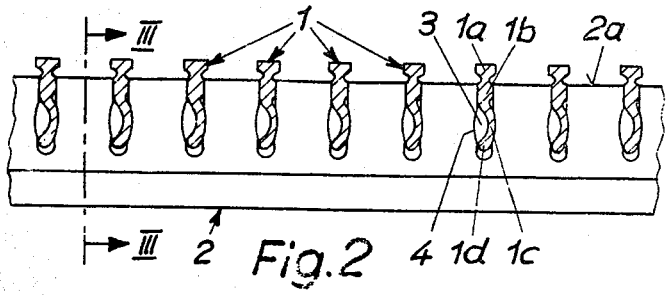
FIG. 2 is a cross-section through the grating shown in FIG. 1.
Figure 3:
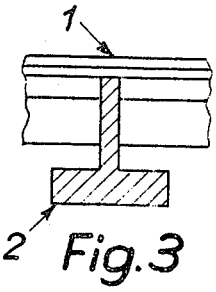
FIG. 3 is a sectional view along the line III—III in FIG. 2.
Figure 4:
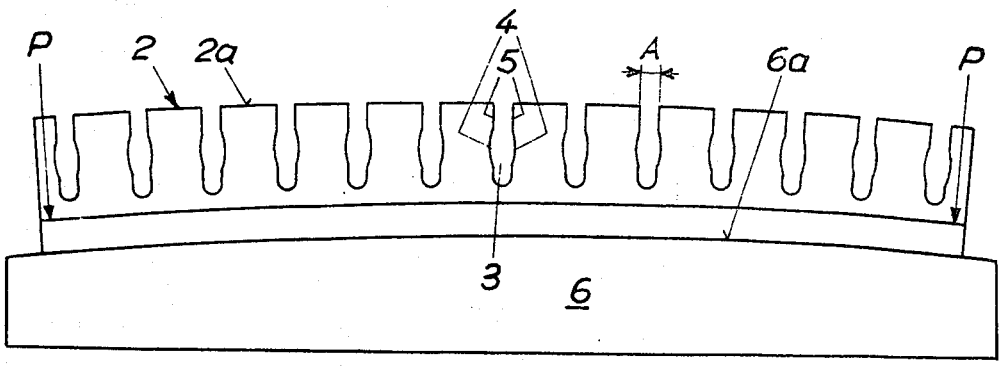
FIG. 4 is a diagrammatic view of an elastically bent cross piece on a convex molded body with slightly widened slots for insertion of the longitudinal bars.

The grating shown in FIGS. 1–3 is composed of longitudinal profile bars 1 and T-shaped cross pieces 2 which comprise a cross bar provided with slots 3. The slots 3 of the cross pieces 2 comprise, at a certain distance from the upper edge 2*a*, a hollow having circular wall parts 4. On the other hand, the wall parts 5 of the slots 3, which are open at the upper edge 2*a*, are disposed parallel to each other and at right angles to the longitudinal extension of the cross pieces.

The longitudinal profile bars 1 comprise a head 1*a* which projects over the upper edge 2*a* of the cross pieces 2. The part which projects into the slot 3 consists of a shoulder 1*b* having parallel side edges and a sectional piece 1*c*. The radius of the convex side of the sectional piece 1*c* corresponds exactly to the radius of the hollow of the wall parts 4 of the slot 3, and thus the bent sectional piece 1*c* can be pressed completely against this wall part 4, while its rounded lower end 1*d* rests on the opposite wall part. The spacing A of the parallel wall parts 5 of the slot 3 is smaller by about 1/10 mm than the width of the shoulder 1*b* and thus, in the assembled state, the longitudinal profile bars 1 are clamped in a cushioned manner against the shoulders 1*b* of the wall parts 5. They are also clamped in a force-locking manner in the slots 3 by the bent sectional part 1*c*.

The grating is extremely simple to assemble. The cross pieces 2 are elastically bent on a molded body 6 having a convex surface 6*a* by exerting pressure P on their two ends, without exceeding the elastic limit of the material. The mouths of the slots 3, that is, the distances A, are slightly widened thereby. The longitudinal profile bars 1 can now be placed easily in the slots 3 and the bent part 1*c* is clamped to some extent in the hollow of the slot 3. When the cross pieces 2 are released from the molded body 6, they regain their original form and the shoulder parts 1*b* are held fast by the wall parts 5 of the slots 3 owing to the fact that the wall parts 5 are slightly smaller than the shoulders 1*b*.

When a load is placed on the grating, for example, when someone walks across it, the longitudinal profile bars 1 are gripped even more firmly.

Figure 5:
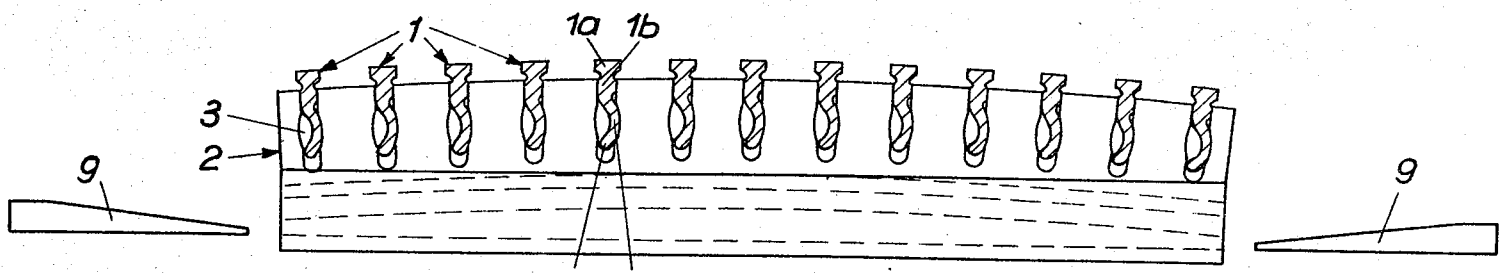
FIG. 5 is a cross-sectional view through a second embodiment of a grating in an intermediate assembly stage.
Figure 6:
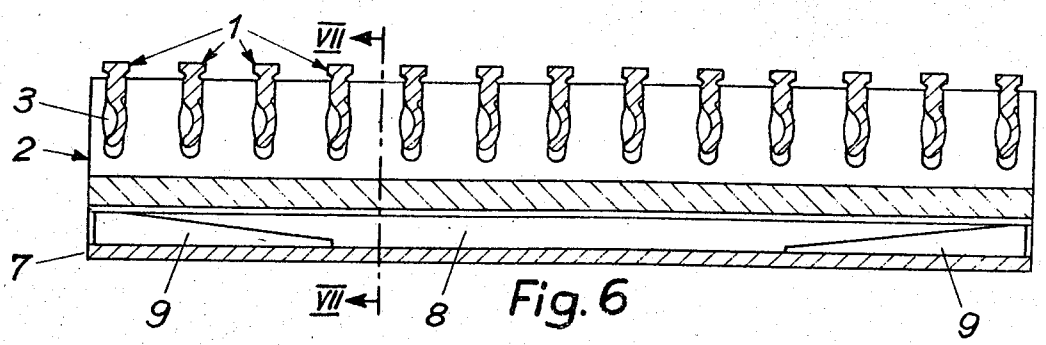
FIG. 6 is a cross-sectional view along the line VI—VI in FIG. 7
Figure 7:
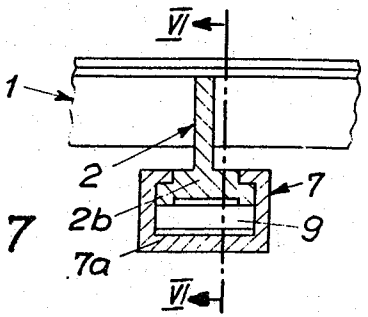
FIG. 7 is a sectional view along the line VII—VII in FIG. 6.

The embodiment according to FIGS. 5–7 differs from the first embodiment merely in that the configuration of the cross piece is slightly different. The longitudinal profile bars 1 and the configuration of the slots 3 are identical with the first embodiment. However, the flange 2*b* of the cross piece 2 is enclosed by a bar 7 having a C-shaped cross-section in such a way that there is a gap 8 between the flange 2*b* of the cross piece and the flange part 7*a* of the bar 7. As represented in FIGS. 6 and 7, wedges 9 are then inserted into this gap 8 at both ends of the cross pieces 2. As a result, it is possible to ensure that the cross pieces 2 are absolutely straight. In this way it is possible to further reduce the difference in the value A of the wall parts 5 with respect to the width of the shoulder. Upon removal of the molded body 6, the assembled grating is then slightly upwardly curved, as represented in FIG. 5. When the bar 7 is then pushed onto the flange 7*a* and the wedges 9 are inserted, the longitudinal profile bars 1 are clamped even more firmly than in the embodiment shown in FIGS. 1–3.

What is claimed is:

1. A grating composed of interlocking and disassemblable longitudinal profile bars and slotted cross pieces, said cross pieces having an upper edge and intended for coverings, sheathings, etc., characterized in that the slots (3) punched in the cross pieces (2) extend from said upper edge and comprise a hollow defined by curved walls (4) at a certain distance from the upper edge (2*a*), in that the longitudinal profile bars (1) are without slots and their parts which engage in the slots of the cross pieces (2) comprise a wall part (1*c*) which is bent to one side, the convex side of this wall part is elastically compressed and frictionally bound against the one wall (4) of the hollow of the slot (3).

2. A process for producing the grating as claimed in claim 1, wherein the slotted cross pieces (2) are elastically bent by clamping them on a convex molded body (6) in such a way that the upper sides of the slots (3) are widened and the longitudinal profile bars (1) are then inserted in the widened slots and the cross pieces (2) are subsequently released, the slots (3) thus being reduced to their original dimensions and clamping the longitudinal profile bars (1) in a flexible manner.

3. A grating composed of interlocking and disassemblable longitudinal profile bars and slotted cross pieces, said cross pieces having an upper edge, and intended for coverings, sheathings, etc., characterized in that the slots (3) punched in the cross pieces (2) extend from said upper edge and comprise a hollow defined by curved walls (4) at a certain distance from the upper edge (2*a*), in that the longitudinal profile bars (1) are without slots and their parts which engage in the slots of the cross pieces (2) comprise a wall part (1*c*) which is bent to one side, the convex side of this wall part is elastically compressed and frictionally bound against the one wall (4) of the hollow of the slot (3), said cross pieces having a T-shaped cross section, characterized in that the flange (2*b*) of the cross-pieces (2) is enclosed by a bar (7) having a C-shaped cross section and a gap (8), into which wedges (9) are pressed at both ends, and is thus formed between the flange (2*b*) of the cross piece and the flange (7*a*) of the C-shaped bar (7).

* * * * *